US009120116B2

(12) United States Patent
Gorman et al.

(10) Patent No.: US 9,120,116 B2
(45) Date of Patent: Sep. 1, 2015

(54) DISPENSER AND METHOD OF DISPENSING AND CONTROLLING WITH A FLOW METER

(71) Applicant: Nordson Corporation, Westlake, OH (US)

(72) Inventors: Michael Gorman, Oceanside, CA (US); Yuriy Suhinin, San Diego, CA (US); Horatio Quinones, San Marcos, CA (US)

(73) Assignee: NORDSON CORPORATION, Westlake, OH (US)

( * ) Notice: Subject to any disclaimer, the term of this patent is extended or adjusted under 35 U.S.C. 154(b) by 0 days.

(21) Appl. No.: 14/462,809

(22) Filed: Aug. 19, 2014

(65) Prior Publication Data

US 2014/0353333 A1 Dec. 4, 2014

Related U.S. Application Data

(60) Division of application No. 14/062,345, filed on Oct. 24, 2013, which is a continuation of application No. 13/753,038, filed on Jan. 29, 2013, now abandoned.

(60) Provisional application No. 61/728,886, filed on Nov. 21, 2012.

(51) Int. Cl.

| | |
|---|---|
| ***B05C 11/10*** | (2006.01) |
| ***B05B 15/02*** | (2006.01) |
| ***B05C 5/02*** | (2006.01) |

(52) U.S. Cl.

CPC ..... *B05C 11/1013* (2013.01); *B05B 15/02* (2013.01); *B05C 5/0225* (2013.01); *B05C 5/0291* (2013.01)

(58) Field of Classification Search

USPC ..... 222/1, 55, 23, 71

See application file for complete search history.

(56) References Cited

U.S. PATENT DOCUMENTS

| | | | | |
|---|---|---|---|---|
| 4,090,262 | A * | 5/1978 | Schneider et al. | 366/155.1 |
| 4,430,886 | A | 2/1984 | Rood | |
| 5,188,258 | A | 2/1993 | Iwashita | |

(Continued)

FOREIGN PATENT DOCUMENTS

| | | | |
|---|---|---|---|
| EP | 0499714 | A1 | 8/1992 |
| WO | 89/03104 | A1 | 4/1989 |

(Continued)

OTHER PUBLICATIONS

European Patent Office, International Search Report and Written Opinion in PCT Application No. PCT/US2013/067169, Mar. 4, 2014.

*Primary Examiner* — Donnell Long

(74) *Attorney, Agent, or Firm* — Wood, Herron & Evans, L.L.P.

(57) ABSTRACT

A non-contact jetting dispenser, viscous fluid dispensing system and method. The system includes a viscous fluid dispenser for dispensing the viscous fluid. The system further includes a viscous fluid supply container adapted to hold the viscous fluid. A flow path is provided for the viscous fluid between the viscous fluid supply container and an outlet of the viscous fluid dispenser. An electronic flow meter device is used to produce electrical output signals proportional to the flow rate of the fluid flowing through the flow path. A control is operatively coupled to the electronic flow meter for continuously receiving and processing the electrical output signals and performing a responsive control function in a closed loop manner.

18 Claims, 2 Drawing Sheets

(56) References Cited

U.S. PATENT DOCUMENTS

| | | | | |
|---|---|---|---|---|
| 5,481,260 | A | 1/1996 | Buckler et al. | |
| 7,967,168 | B2 * | 6/2011 | Geier et al. | 222/55 |
| 2002/0060226 | A1 * | 5/2002 | Kameyama | 222/1 |
| 2007/0062642 | A1 * | 3/2007 | Reck et al. | 156/325 |
| 2008/0107796 | A1 * | 5/2008 | Cho | 427/8 |
| 2008/0210706 | A1 * | 9/2008 | Geier et al. | 222/1 |
| 2009/0140007 | A1 * | 6/2009 | Voss | 222/135 |
| 2010/0058985 | A1 * | 3/2010 | Kim et al. | 118/720 |
| 2010/0260531 | A1 * | 10/2010 | Rademacher | 401/146 |
| 2010/0310765 | A1 * | 12/2010 | Olsson et al. | 427/207.1 |
| 2012/0104033 | A1 * | 5/2012 | MacIndoe | 222/1 |
| 2012/0175386 | A1 * | 7/2012 | Tracy et al. | 222/333 |
| 2012/0325864 | A1 * | 12/2012 | Imaizumi et al. | 222/333 |

FOREIGN PATENT DOCUMENTS

| | | | |
|---|---|---|---|
| WO | 9713586 | A1 | 4/1997 |
| WO | 2008002825 | A1 | 1/2008 |

* cited by examiner

DISPENSER AND METHOD OF DISPENSING AND CONTROLLING WITH A FLOW METER

CROSS-REFERENCE TO RELATED APPLICATION

This application is a divisional of application Ser. No. 14/062,345, filed Oct. 24, 2013 (pending), which is a continuation of application Ser. No. 13/753,038, filed Jan. 29, 2013 (abandoned) which claims the priority of Application Ser. No. 61/728,886, filed Nov. 21, 2012, the disclosures of which are hereby incorporated by reference herein.

TECHNICAL FIELD

The present invention relates generally to the field of fluid dispensers that accurately dispense small amounts of viscous fluids in various forms such as dots or droplets, or lines.

BACKGROUND

In the manufacture of various items, such as printed circuit ("PC") boards, it is frequently necessary to apply small amounts of viscous fluid materials, i.e. those with a viscosity greater than fifty centipoise, to substrates. Such materials include, by way of example and not by limitation, general purpose adhesives, solder paste, solder flux, solder mask, grease, oil, encapsulants, potting compounds, epoxies, die attach pastes, silicones, RTV and cyanoacrylates.

As one example, a fabrication process known as flip chip technology has developed, which has multiple processes that require viscous fluid dispensing. For example, a semiconductor die or flip chip is first attached to a PC board via solder balls or pads, and in this process, a viscous solder flux is applied between the flip chip and the PC board. Next, a viscous liquid epoxy is dispensed and allowed to flow and completely cover the underside of the chip. This underfill operation requires that a precise amount of the liquid epoxy be deposited along at least one side edge of the semiconductor chip. As the volume of the epoxy decreases during the curing process, a pseudo-hydrostatic state of stress will be imposed on the solder balls or pads, and this will provide resistance to deformation of the solder balls or pads, and therefore resistance to fracture. The liquid epoxy flows under the chip as a result of capillary action due to the small gap between the underside of the chip and the upper surface of the PC board. Once the underfill operation is complete, it is desirable that enough liquid epoxy be deposited to encapsulate all of the electrical interconnections, so that a fillet is formed along the side edges of the chip. A properly formed fillet ensures that enough epoxy has been deposited to provide maximum mechanical strength of the bond between the chip and the PC board. It is critical to the quality of the underfilling process that the exact amount of epoxy is deposited at exactly the right location. Too little epoxy can result in corrosion and excessive thermal stresses. Too much epoxy can flow beyond the underside of the chip and interfere with other semiconductor devices and interconnections. These parameters must be accurately controlled in the context of manufacturing environments that require high speed productivity.

In another application, a chip is bonded to a PC board. In this application, a pattern of adhesive is deposited on the PC board; and the chip is placed over the adhesive with a downward pressure. The adhesive pattern is designed so that the adhesive flows evenly between the bottom of the chip and the PC board and does not flow out from beneath the chip. Again, in this application, it is important that a precise amount of adhesive be deposited at exact locations on the PC board.

The PC board is often being carried by a conveyor past a viscous material dispenser that is mounted for two axes of motion above the PC board. The moving dispenser is often of the type capable of depositing small dots or droplets of viscous material at desired locations on the PC board. This type of dispenser is commonly referred to as a non-contact jetting dispenser. There are several variables that are often controlled in order to provide a high quality viscous material dispensing process. First, the weight or size of each of the dots is controlled. Known viscous material dispensers have closed loop controls that are designed to hold the dot size constant during the material dispensing process. It is known to control the dispensed weight or dot size by varying the supply pressure of the viscous material, the on-time of a dispensing valve within the dispenser and the stroke length of a valve member of the jetting dispenser. Known control loops have advantages and disadvantages depending on the design of a particular dispenser and the viscous material being dispensed. However, known techniques often require additional components and mechanical structure, such as weigh scales, thereby introducing additional cost, time and reliability issues. Further, known methods often involve the use of calibration procedures, separate from the manufacturing process, which reduces productivity. Therefore, there is a continuing need to provide faster and simpler means for controlling parameters such as dot size, and dispensed fluid volume or weight.

Another important variable that may be controlled in the dispensing process is the total amount or volume of viscous material to be dispensed in a particular cycle. Often the designer of a chip specifies the total amount or volume of viscous material, for example, epoxy in underfilling, or adhesive in bonding, that is to be used in order to provide a desired underfilling or bonding process. In jetting, for example, for a given dot size and dispenser velocity, it is known to program a dispenser control so that the dispenser dispenses a proper number of dots to dispense a specified amount of the viscous material in a desired line or pattern at the desired location. Such a system is reasonably effective when the dispensing parameters remain constant. However, such parameters are constantly changing, albeit, often only slightly over the short term. The cumulative effect of such changes can result in an undesirable change in the volume of fluid being dispensed by the dispenser. Therefore, there is also a need for a control system that can detect changes in dispensed weight and make automatic adjustments, so that the desired total volume of viscous material is uniformly dispensed over an entire dispensing cycle.

Generally, there is a need for an improved computer controlled viscous fluid dispensing system that addresses these and other challenges of accurately dispensing small amounts of viscous fluid in high productivity manufacturing processes and the like.

SUMMARY

The invention provides a viscous fluid dispensing system for accurately dispensing viscous fluid and controlling a dispensing operation. The system includes a viscous fluid dispenser with an inlet and an outlet. The dispenser may be operated to start and stop dispensing of the viscous fluid through the outlet onto a substrate in various manners. The dispensing may involve various types of discrete volume outputs, such as dots, droplets or lines of the viscous fluid, or other types of outputs. The system further includes a viscous fluid supply container adapted to hold the viscous fluid, and coupled in fluid communication with the inlet of the viscous fluid dispenser to establish a flow path for the viscous fluid between the viscous fluid supply container and the outlet of the viscous fluid dispenser. An electronic flow meter device is operatively coupled in the flow path to produce electrical output signals proportional to the flow rate of the fluid flowing through the flow path when the dispenser is dispensing the fluid through the outlet. A control is operatively coupled to the electronic flow meter for continuously receiving and processing the electrical output signals and performing a responsive control function in a closed loop manner.

The electronic flow meter device is alternatively provided in communication with a pneumatic side of the system. That is, when the viscous fluid supply is operated by pressurized air, an electronic flow meter may be used to produce electrical output signals proportional to the flow rate of the pressurized air being used to force the viscous fluid from the supply into the flow path, and ultimately dispensing through the outlet. A control is operatively coupled to the electronic flow meter for continuously receiving and processing the electrical output signals and performing a responsive control function in a closed loop manner. In this embodiment, the flow rate of the actuating air is correlated by the control to the resulting flow rate of the viscous fluid being dispensed.

Various additional or alternative aspects may be included in the system. The electrical output signals may be in the form of an output data set. A reference data set is stored in the control, and the processing includes comparing the output data set to the reference data set. Processing the electrical output signals further comprise detecting an discrepancy in the flow rate of the viscous fluid flowing through and being dispensed from the outlet of the dispenser. In this case, the responsive control function further comprises making an adjustment to change the flow rate of the viscous fluid flowing through and being dispensed from the outlet of the dispenser. Other control functions to maintain desired dispense amounts are also possible. For example, total dispense time may be adjusted to change the total volume dispensed or the velocity at which the dispenser is moved relative to the substrate may be adjusted. Processing the electrical output signals further comprises detecting an air bubble in the viscous fluid flowing through the dispenser and/or detecting a clogged or semi-clogged condition. In the cases of detecting conditions such as these, the control may provide a suitable indication to an operator, such as an alarm sound or light indicator, or an indication on a screen or monitor associated with the control.

In different embodiments, the electronic flow meter may be located in various places, such as in the dispenser or coupled with a supply conduit leading to dispenser, or also mentioned above, coupled in a pressurized air supply path leading to the viscous material supply container. The control may process the electrical output signals and perform the responsive control function while the viscous fluid dispenser is dispensing the viscous fluid onto the substrate. In other embodiments, the control operates to process the electrical output signals and perform the responsive control function while the viscous fluid dispenser is located away from the substrate and at a calibration station.

A method of controlling a viscous fluid dispensing system to accurately dispensing viscous fluid is also provided. Generally, the method includes directing a viscous fluid from a viscous fluid supply into a dispenser and discharging the viscous fluid from an outlet of the dispenser. An electronic flow meter device is operatively coupled in a flow path between the supply and the outlet of the dispenser and produces electrical output signals proportional to the flow rate of the fluid flowing through the flow path. The electrical output signals are processed and a responsive control function is performed in a closed loop manner. Additional aspects of the method will be understood from a review of the system operation discussed above and in more detail below.

In another alternative method, the flow meter is coupled to a pressurized air flow path leading to the viscous fluid supply container, and the flow of air is monitored and correlated to the resulting flow of viscous fluid. The electrical output signals are then used to enable the performance of desired control functions by a control as described herein.

In another embodiment, a non-contact jetting dispenser system is provided and includes a non-contact jetting dispenser having a viscous material inlet and a viscous material outlet. The dispenser is operable to start and stop the flow of the viscous fluid from the outlet onto a substrate. The non-contact jetting dispenser includes a viscous fluid supply container adapted to hold the viscous fluid, and coupled in fluid communication with the inlet of the viscous fluid dispenser to establish a flow path for the viscous fluid between the viscous fluid supply container and the outlet of the viscous fluid dispenser. The non-contact jetting dispenser system further includes an electronic flow meter device operatively coupled in the flow path to produce electrical output signals proportional to the flow rate of the fluid flowing through the flow path when the fluid is jetted from the outlet.

These and other objects and advantages of the invention will become more readily apparent during the following detailed description taken in conjunction with the drawings herein.

DETAILED DESCRIPTION

Figure 1:
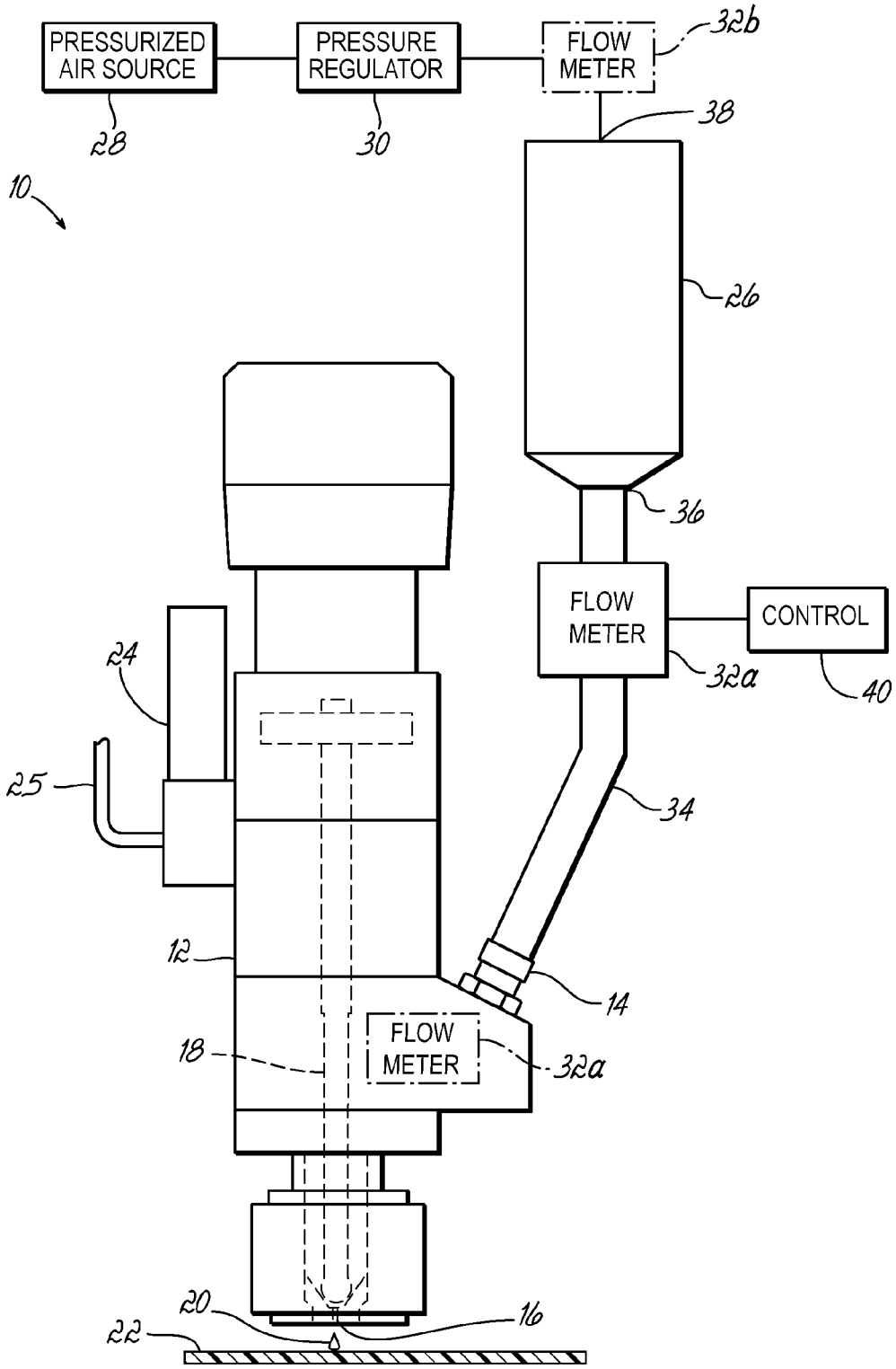
FIG. 1 is an elevational view of a viscous fluid dispensing system constructed according to an illustrative embodiment of the invention.

FIG. 1 is a schematic illustration of a viscous fluid dispensing system 10 for accurately dispensing viscous fluid and controlling a dispensing operation. The system 10 includes a viscous fluid dispenser 12 with a viscous fluid inlet 14, a dispensing outlet 16 for the viscous fluid and an internal, movable valve 18 for controlling an on/off dispensing operation of viscous fluid 20 onto a substrate 22. The valve 18 is movable between open and closed positions to dispense the viscous fluid 20 from the outlet 16 onto the substrate 22, for example, in discrete volumes. The invention is not limited to this type of method or structure for starting and stopping the flow from a dispenser. For example, other types of dispensers may be used that rely on pressure induced manners of starting and stopping flow. The dispenser 12 may be of any suitable type and configuration, depending on the dispensing application and needs of the user. In general, the dispenser may dispense continuous lines or other patterns of the viscous fluid 20 onto the substrate 22 or may be a jetting type dispenser that rapidly dispenses small, discrete volumes of the viscous fluid in the form of dots or droplets. For example, such jetting dispensers are available from Nordson ASYMTEK, Carlsbad, Calif., under the names DispenseJet® and NexJet™. The dispenser 12 may be operated, for example, pneumatically or electrically. As shown, the dispenser 12 includes or is coupled with a solenoid valve 24 that regulates the introduction of pressurized actuation air through a line or conduit 25 in a known manner to move the valve 18 at least to the open position. In a dual air chamber dispenser, pressurized air would be also used to move the valve 18 to the closed position. In other embodiments, a spring may be used to move the valve 18 to the closed position.

The system 10 further includes a viscous fluid supply container 26 adapted to hold the viscous fluid 20, and coupled in fluid communication with the inlet 14 of the dispenser 12 to establish a flow path for the viscous fluid between the viscous fluid supply container 26 and the outlet 16 of the viscous fluid dispenser 12. In this embodiment, the supply of fluid 20 in the container 26 is pressurized with air from a suitable source 28 regulated by a pressure regulator 30. An electronic flow meter 32*a*, or flow rate sensor device, is coupled in the flow path to produce electrical output signals proportional to the flow rate of the fluid 20 flowing through the flow path when the valve 18 is in the open position. The flow meter 32*a* may be coupled directly in a fluid line or conduit 34 extending from an outlet 36 of the supply container 26 to the inlet 14 of the dispenser 12. In this embodiment, the flow meter 32*a* is preferably a Sensirion model LG 16-2000 or LG 16-1000 liquid flow sensor, or a model SLQ-QT105 flow sensor, available from Sensirion AG, Switzerland. The specific model of flow meter chosen will typically depend on the flow rates required for the application, and such factors as response time and sensitivity. In other embodiments, the flow meter 32*a* may be incorporated directly in the dispenser 12, anywhere in the flow path upstream from the outlet 16, as shown in broken lines in FIG. 1. Another alternative, for example, would be locating the flow meter 32*a* in the nozzle 16. In yet another embodiment, a gas flow meter 32*b* may be coupled to the pneumatic actuating side of the system. For example, the gas flow meter 32*b* may be coupled between the pressure regulator 30 and the inlet 38 of the container 26. A control 40 is operatively coupled to the electronic flow meter 32*a* or 32*b*, regardless of its position in the system. The control 40 continuously receives and processes the electrical output signals indicative of either viscous fluid or gas flow rate data points respectively from the flow meter 32*a* or 32*b* and performs a responsive control function in a closed loop manner, as will be discussed further below. The control 40, for example, may be a PLC or programmable logic controller, or any other suitable computer-based control device capable of processing the signals from the flow meter 32*a* or 32*b* and carrying out the functions to be discussed below. The applications for the system 10, as well as the fluid materials to be dispensed, may be of any desired type including those discussed in the background above.

Figure 2:
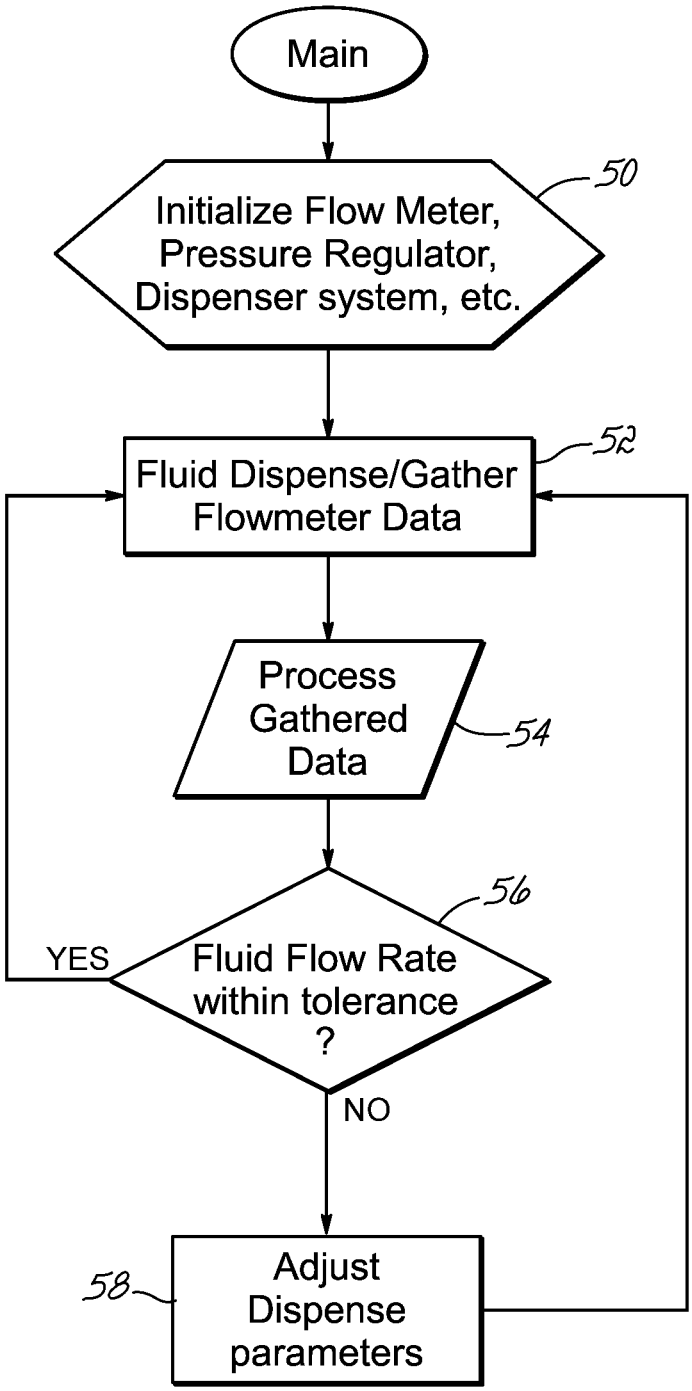
FIG. 2 is a flow diagram illustrating the steps performed by a control associated with the system shown in FIG. 1.

FIG. 2 illustrates a general flow diagram of the software to be implemented and carried out by the control 40. In a first step 50, the flow meter 32*a* or 32*b*, pressure regulator 30 and any other control components associated with the dispenser 12 are initialized to start a dispensing operation. In the next step 52 the dispenser 12 begins dispensing the viscous fluid in the desired manner, as programmed and carried out by the control 40, for example, to rapidly dispense multiple dots or droplets, or a line of the fluid 20 onto the substrate 22 (FIG. 1). While the dispensing operation is being carried out, viscous fluid or air flow data points (signals) are collected by the control 40 from the flow meter 32*a* or 32*b*. This data is processed in step 54, in one or more manners, to be discussed further below. For example, the processing in step 54 can involve a comparison of the gathered data set to a stored reference data set or other analysis. At step 56, the control 40 determines whether the flow rate of the viscous fluid is within tolerance. If the flow rate is within tolerance, the process returns to step 52 and continues the dispensing operation. If the fluid flow rate is not within tolerance, the dispense parameters are adjusted accordingly at step 58. The control 40 then continues to carry out the dispensing operation and the control functions in a closed loop manner.

In order to analyze the data or signals gathered from the flow meter 32*a* or 32*b*, the control 40 may, for example, compares the output data from the flow meter 32*a* or 32*b* to stored reference data. The output data from the flow meter 32*a* or 32*b*, for example, may be a data set. The data set may be plotted graphically as flow rate vs. time. As a result, a curve or wave form may be generated by the control 40. A generally square wave may be created, in which the signal peaks while the dispenser valve 18 is open and then rapidly falls off when the valve is closed. During a jetting operation, the wave or curve generated by the flow signal data output from the flow meter 32*a* or 32*b* will resemble a sawtooth pattern along the curve indicating the rapid on and off or open and closed conditions of the valve 18 as the fluid material 20 is rapidly jetted as dots from the dispenser outlet 16. When the valve 18 is maintained in a closed position at the end of the jetting operation, the wave form or curve will fall to zero. In this operation, the analysis performed by the control 40 may compare the wave form generated by data (signals) from the flow meter 32*a* or 32*b* to a reference wave form which represents a more ideal flow pattern. If the two wave forms or curves being compared are dissimilar, the control 40 makes adjustments to the system 10 for purposes of changing the flow characteristics. More generally, the control 40 compares a current or real time data set which is based on signals from the flow meter 32*a* or 32*b*, and representative of viscous fluid or air flow, and compares that real time data set to an analogous reference data set of viscous fluid or air flow. Based on detecting discrepancies between the two data sets that are being compared, the control is programmed to then make adjustments to the flow characteristics of the system 10. It is not necessary that the data set actually be assembled as a wave form by the control 40. These adjustments may, for example, include adjustments to the pressure regulator 30, the open time of the valve 18, the temperature of the viscous fluid 20, or other parameters. In the case of a continuous dispense operation having a dispense cycle in which the valve 18 is continuously open to dispense, for example, a line of viscous fluid 20, the wave form may be even more square-shaped.

The analysis performed upon gathering the signals/data from the flow meter 32*a* or 32*b* may involve various processes and/or algorithms. One process may involve comparing the average of the peaks in the detected wave form with a reference or ideal wave form stored in the control 40. Another method can involve determining the area underneath the wave form (i.e., integrate under the curve) and comparing that area with reference data.

In the case of dispensing lines of fluid 20 or jetting dots of fluid 20, a data set representing proper flow during the dispensing, or jetting, can be stored as a reference data set, and then compared to the real time data set from the flow meter 32*a* or 32*b*. If the real time data set varies from the reference data set, then corrections can be made to dispensing, or jetting, such as by changing the air pressure to the syringe or container 26 that supplies the fluid 20. Corrections can be made very quickly, such as within a response time of 40 milliseconds. For example, there is typically on the order of 100 milliseconds between two consecutive dispenses and this time may be used to make the adjustment or correction to the flow characteristics without affecting process time. Consequently, corrections can be made between the end of one dispense or jetting operation and the beginning of the next dispense or jetting operation. This very short response time compares to several minutes which may be required to dispense fluid material on a weigh scale, weigh it, calculate flow, etc. as per prior calibration procedures.

The system 10 can also be used to detect one or more air bubbles that discharge through the outlet 16. In this case, the flow meter 32*a* or 32*b* will detect a momentary increase in flow rate as the air bubble passes through the dispenser outlet 16. This momentary increase in flow rate, if detected by the control 40 based on signals from the flow meter 32*a* or 32*b*, may be used to indicate the problem to the operator, such as through an alarm, signal light, or other indicator on a control or computer screen. The operator may then inspect the substrates 22 for any quality issues and perform any necessary maintenance of the system 10. The system 10 may also be used to detect a clogged or semi-clogged condition associated with the dispenser 12 and, most likely, associated with the nozzle or outlet 16 of the dispenser 12. In this case, the flow meter 32*a* or 32*b* will detect either no flow or significantly reduced flow. If this condition is detected, the signals from the flow meter 32*a* or 32*b* may be used by the control 40 to indicate the condition to the operator, such as by use of an alarm sound, light or other indicator such as on a computer or control screen. This will allow the operator to shut the system down for maintenance purposes. Quick shut down of the system 10 due to a problem such as air bubbles or clogged conditions will minimize product waste and increase yield.

It will be appreciated that the system 10 may be used for on-the-fly adjustments to the dispense parameters and on-the-fly detection purposes as discussed above, while a manufacturing process involving the dispense operation is underway. That is, the routine depicted in FIG. 2 may be in continuous use during the manufacturing process such that dispense parameters are adjusted during manufacturing to increase productivity unlike those systems that involve a separate calibration step or procedure and calibration station. The system 10 may also or alternatively be used with a calibration station in which the dispenser 12 is taken off-line to a calibration station and the routine shown in FIG. 2 is performed at the calibration station as opposed to being performed on-the-fly during the manufacturing process. Even this use of the system 10 at a calibration station has advantages. For example, less fluid material 20 will be used than in typical calibration stations using weigh scales and the calibration and adjustment process will be faster and potentially more accurate. Certain fluid materials, such as flux, are volatile and the solvents associated with these fluids will evaporate when exposed at atmosphere. Thus, if a weigh scale process takes enough time to allow evaporation, the results will be less accurate. With the system 10 of this invention, the flow data is collected by the control 40 in an amount of time that approaches real time. Evaporation of solvents associated with the fluid is not a factor in this metrology.

While the present invention has been illustrated by a description of several embodiments, and while such embodiments have been described in considerable detail, there is no intention to restrict, or in any way limit, the scope of the appended claims to such detail. Additional advantages and modifications will readily appear to those skilled in the art. Therefore, the invention in its broadest aspects is not limited to the specific details shown and described. The various features disclosed herein may be used in any combination necessary or desired for a particular application. Consequently, departures may be made from the details described herein without departing from the spirit and scope of the claims which follow.

What is claimed is:

1. A viscous fluid dispensing system for accurately dispensing viscous fluid and controlling a dispensing operation, the system comprising:

a viscous fluid dispenser including an inlet and an outlet, the dispenser being operable to start and stop the flow of the viscous fluid from the outlet onto a substrate;

a viscous fluid supply container adapted to hold the viscous fluid, and having an outlet coupled in fluid communication with the inlet of the viscous fluid dispenser to establish a flow path for the viscous fluid between the viscous fluid supply container and the outlet of the viscous fluid dispenser, the viscous fluid supply container further including an pneumatic input adapted to receive pressurized air for forcing the viscous fluid from the outlet of the container;

an electronic flow meter device operatively coupled in the pneumatic input of the container to produce electrical output signals proportional to the flow rate of the pressurized air received through the pneumatic input when the fluid is being dispensed from the outlet; and a control operatively coupled to the electronic flow meter for continuously receiving and processing the electrical output signals and performing a responsive control function in a closed loop manner.

2. The viscous fluid dispensing system of claim 1, wherein the electrical output signals are in the form of an output data set, a reference data set is stored in the control, and the processing includes comparing the output data set to the reference data set.

3. The viscous fluid dispensing system of claim 1, wherein processing the electrical output signals further comprises detecting a discrepancy in the flow rate of the viscous fluid flowing through and being dispensed from the outlet of the dispenser, and the responsive control function further comprises making an adjustment to change the flow rate of the viscous fluid flowing through and being dispensed from the outlet of the dispenser.

4. The viscous fluid dispensing system of claim 1, wherein processing the electrical output signals further comprises detecting an air bubble in the viscous fluid flowing through the dispenser.

5. The viscous fluid dispensing system of claim 4, wherein performing a response control function further comprises providing an indication to an operator that an air bubble has been detected.

6. The viscous fluid dispensing system of claim 1, wherein processing the electrical output signals further comprises detecting a clogged or semi-clogged condition of the dispenser.

7. The viscous fluid dispensing system of claim 6, wherein performing a responsive control function further comprises providing an indication to an operator that the clogged or semi-clogged condition has been detected.

8. The viscous fluid dispensing system of claim 1, wherein the control operates to process the electrical output signals and perform the responsive control function while the viscous fluid dispenser is dispensing the viscous fluid onto the substrate.

9. The viscous fluid dispensing system of claim 1, wherein the control operates to process the electrical output signals and perform the responsive control function while the viscous fluid dispenser is located away from the substrate and at a calibration station.

10. A method of controlling a viscous fluid dispensing system to accurately dispensing viscous fluid, comprising:

directing a viscous fluid from a viscous fluid supply container into a dispenser using pressurized air flowing through a pneumatic input of the viscous fluid supply container;

discharging the viscous fluid from an outlet of the dispenser;

using an electronic flow meter device operatively coupled to the pneumatic input of the viscous fluid supply container to produce electrical output signals proportional to the flow rate of the pressurized air flowing through the pneumatic input; and processing the electrical output signals and performing a responsive control function in a closed loop manner.

11. The method of claim 10, wherein the electrical output signals are in the form of an output data set, a reference data set is stored in the control, and the processing includes comparing the output data set to the reference data set.

12. The method of claim 10, wherein processing the electrical output signals further comprises detecting an discrepancy in the flow rate of the viscous fluid flowing through and being dispensed from the outlet of the dispenser, and the responsive control function further comprises making an adjustment to change the flow rate of the viscous fluid flowing through and being dispensed from the outlet of the dispenser.

13. The method of claim 10, wherein processing the electrical output signals further comprises detecting an air bubble in the viscous fluid flowing through the dispenser.

14. The method of claim 13, wherein performing a response control function further comprises providing an indication to an operator that an air bubble has been detected.

15. The method of claim 10, wherein processing the electrical output signals further comprises detecting a clogged or semi-clogged condition of the dispenser.

16. The method of claim 15, wherein performing a responsive control function further comprises providing an indication to an operator that the clogged or semi-clogged condition has been detected.

17. The method of claim 10, wherein processing the electrical output signals and performing the responsive control function occur while the viscous fluid dispenser is dispensing the viscous fluid onto a substrate.

18. The method of claim 10, wherein processing the electrical output signals and performing the responsive control function occur while the viscous fluid dispenser is located away from a substrate and at a calibration station.

* * * * *